US010249243B2

(12) United States Patent
Li

(10) Patent No.: US 10,249,243 B2
(45) Date of Patent: Apr. 2, 2019

(54) GOA CIRCUIT

(71) Applicant: Wuhan China Star Optoelectronics Technology Co., Ltd., Wuhan (CN)

(72) Inventor: Yafeng Li, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 107 days.

(21) Appl. No.: 15/506,241

(22) PCT Filed: Dec. 30, 2016

(86) PCT No.: PCT/CN2016/113319
§ 371 (c)(1),
(2) Date: Feb. 24, 2017

(87) PCT Pub. No.: WO2018/119964
PCT Pub. Date: Jul. 5, 2018

(65) Prior Publication Data

US 2018/0218682 A1 Aug. 2, 2018

(30) Foreign Application Priority Data

Dec. 27, 2016 (CN) ..... 2016 1 1228607

(51) Int. Cl.
*G09G 3/3258* (2016.01)
*G09G 3/3266* (2016.01)
*G09G 3/36* (2006.01)

(52) U.S. Cl.
CPC ..... *G09G 3/3258* (2013.01); *G09G 3/3266* (2013.01); *G09G 3/3677* (2013.01); (Continued)

(58) Field of Classification Search
CPC .. G09G 3/3266; G09G 3/3648; G09G 3/3677; G09G 3/3258; G09G 2310/0289; (Continued)

(56) References Cited

U.S. PATENT DOCUMENTS

2016/0086562 A1* 3/2016 Tan ..... G09G 3/3677 345/215
2017/0032752 A1* 2/2017 Huang ..... G09G 3/3648
2017/0116924 A1* 4/2017 Zhang ..... G09G 3/3233

FOREIGN PATENT DOCUMENTS

CN 106128379 A 11/2016
CN 106205461 A 12/2016

* cited by examiner

*Primary Examiner* — Lunyi Lao
*Assistant Examiner* — Johny Lau
(74) *Attorney, Agent, or Firm* — Leong C. Lei

(57) ABSTRACT

The present invention relates to a GOA circuit. The GOA circuit of the present invention comprises a plurality of GOA circuit units which are cascade coupled, wherein n is set to be a natural number larger than 0, and the nth level GOA circuit unit comprises: a first thin film transistor (T1), a second thin film transistor (T2), a third thin film transistor (T3), a fourth thin film transistor (T4), a fifth thin film transistor (T5), a sixth thin film transistor (T6), a seventh thin film transistor (T7), an eighth thin film transistor (T8), a ninth thin film transistor (T9), a tenth thin film transistor (T10), a first capacitor (C1) and a second capacitor (C2). Moreover, two control signals (Select1, Select2) are introduced. The present invention provides a new GOA circuit. The circuit possesses MLG function, which can effectively reduce the feedthrough and improve the Vcom uniformity in the panel to promote the quality of the image display.

16 Claims, 5 Drawing Sheets

(52) U.S. Cl.
CPC ..... *G09G 2310/0289* (2013.01); *G09G 2310/067* (2013.01); *G09G 2310/08* (2013.01); *G09G 2320/0209* (2013.01); *G09G 2320/0219* (2013.01)

(58) Field of Classification Search
CPC ..... G09G 2310/067; G09G 2310/08; G09G 2320/0209; G09G 2320/0219
See application file for complete search history.

GOA CIRCUIT

FIELD OF THE INVENTION

The present invention relates to a display device field, and more particularly to a GOA circuit.

BACKGROUND OF THE INVENTION

Gate Driver On Array (GOA) technology is a kind of technology that the thin film transistor liquid crystal display array (Array) process is utilized to manufacture the Gate row scan drive signal circuit on the array substrate to realize the drive manner to scan the gates row by row.

Please refer to FIG. 1, which is a circuit diagram of a GOA circuit according to prior art. The GOA circuit of prior art comprises a plurality of GOA circuit units which are cascade coupled, wherein the nth level GOA circuit unit outputting a nth level horizontal scan signal comprises: a first thin film transistor T1, of which a gate is coupled to a signal output point Gn−2 of the n−2th level GOA circuit unit, and a source and a drain are respectively coupled to a node Hn and inputted with a forward scan control signal U2D; a second thin film transistor T2, of which a gate is coupled to the node Qn, and a source and a drain are respectively coupled to a signal output point Gn of the nth level GOA circuit unit and inputted with a clock signal CKV2; a third thin film transistor T3, of which a gate is coupled to a signal output point Gn+2 of the n+2th level GOA circuit unit, and a source and a drain are respectively coupled to the node Hn and inputted with the forward scan control signal D2U; a fourth thin film transistor T4, of which a gate is coupled to a node Pn, and a source and a drain are respectively coupled to the signal output point Gn and the constant low voltage level VGL; a fifth thin film transistor T5, of which a gate is coupled to a constant high voltage level VGH, and a source and a drain are respectively coupled to the node Hn and a node Qn; a sixth thin film transistor T6, of which a gate is coupled to the node Pn, and a source and a drain are respectively coupled to the node Hn and the constant low voltage level VGL; a seventh thin film transistor T7, of which a gate is coupled to the node Hn, and a source and a drain are respectively coupled to the node Pn and a constant low voltage level VGL; an eighth thin film transistor T8, of which a gate is inputted with a clock signal CKV4, and a source and a drain are respectively coupled to the node Pn and the constant high voltage level VGH; a first capacitor C1, of which two ends are respectively coupled to the node Qn and the signal output point Gn; a second capacitor C2, of which two ends are respectively coupled to the node Pn and the constant low voltage level VGL. The node Qn is the point employed to control the output of the gate drive signal; the node Pn is the point employed to maintain the stability of the low voltage levels of the point Qn and the point Gn. FIG. 1 depicts the structure of the GOA circuit unit with the nth level GOA circuit unit corresponding to the output of the level Gn to be an illustration. The structure of the adjacent n+1th level GOA circuit unit corresponding to the output of the level Gn+1 is the same as what is shown in FIG. 1 but only the different clock signal is utilized at work. The description for the structure of the n+1th level GOA circuit unit is omitted here.

Please refer to FIG. 2, which is a forward scan sequence diagram of the GOA circuit in FIG. 1. With combination of FIG. 1, the specific work process (forward scan) of the circuit is introduced below:

the output of the level Gn is illustrated; as forward scan, U2D is the high voltage level, and D2U is the low voltage level;

stage 1, pre-charge stage, Gn−2 and U2D are the high voltage levels at the same time, and T1 is on, and the point Hn is pre-charged. As the point Hn is the high voltage level, T5 is in an on state, and the point Qn is pre-charged. As the point Hn is the high voltage level, T7 is in an on state, and the point Pn is pulled down;

stage 2, Gn outputs the high voltage level: in stage 1, the point Qn is pre-charged, and C1 has a certain maintaining function to the electrical charges, and T2 is in an on state, and the high voltage level of CKV2 is outputted to the end Gn;

stage 3, Gn outputs the low voltage level: C1 has the maintaining function to the high voltage level to the point Qn, and the low voltage level of CKV2 pulls down the point Gn;

stage 4, the point Qn is pulled down to VGL: as Gn+2 is the high voltage level, D2U is the low voltage level, and T3 is in an on state, and thus, the point Qn is pulled down to be VGL;

stage 5, the point Qn and the point of Gn maintain the low voltage level: after the point Qn becomes the low voltage level, T7 is in an off state, and as CKV4 jumps to the high voltage level, T8 is on, and the point Pn is charge, and then both T4 and T6 are in an on state, which can ensure the low voltage level stabilities of the point Qn and the point Gn, and meanwhile, C2 has a certain maintaining function to the high voltage level of the point Pn.

For the n+1th level GOA circuit unit corresponding to the output of the level Gn+1, the used clock signals are CKV1 and CKV3, and the work process can be obtained with combination of FIG. 2.

Please refer to FIG. 3, which is a backward scan sequence diagram of the GOA circuit in FIG. 1. With combination of FIG. 1, the specific work process (backward scan) of the circuit is introduced below:

the output of the level Gn is illustrated; as forward scan, D2U is the high voltage level, and U2D is the low voltage level;

stage 1, pre-charge stage, Gn+2 and D2U are the high voltage levels at the same time, and T3 is on, and the point Hn is pre-charged. As the point Hn is the high voltage level, T5 is in an on state, and the point Qn is pre-charged. As the point Hn is the high voltage level, T7 is in an on state, and the point Pn is pulled down;

stage 2, Gn outputs the high voltage level: in stage 1, the point Qn is pre-charged, and C1 has a certain maintaining function to the electrical charges, and T2 is in an on state, and the high voltage level of CKV2 is outputted to the end Gn;

stage 3, Gn outputs the low voltage level: C1 has the maintaining function to the high voltage level to the point Qn, and the low voltage level of CKV2 pulls down the point Gn;

stage 4, the point Qn is pulled down to VGL: as Gn−2 is the high voltage level, U2D is the low voltage level, and T1 is in an on state, and thus, the point Qn is pulled down to be VGL;

stage 5, the point Qn and the point of Gn maintain the low voltage level: after the point Qn becomes the low voltage level, T7 is in an off state, and as CKV4 jumps to the high voltage level, T8 is on, and the point Pn is charge, and then both T4 and T6 are in an on state, which can ensure the low voltage level stabilities of the point Qn and the point Gn, and meanwhile, C2 has a certain maintaining function to the high voltage level of the point Pn.

For the n+1th level GOA circuit unit corresponding to the output of the level Gn+1, the used clock signals are CKV1 and CKV3, and the work process can be obtained with combination of FIG. 3.

The high, the low voltage levels outputted by Gn of the GOA circuit according prior art respectively are VGH and VGL, and are two stage drive. The feed through voltage corresponded with such gate drive manner is larger, and leads to the inconsistency of the optimized common voltages (Vcom) corresponding to various regions of the panel, which means that the two stage drive can easily cause the worse uniformity of Vcom of the panel and influence the display quality.

SUMMARY OF THE INVENTION

An objective of the present invention is to provide a new GOA circuit, and the circuit can realizes the multiple level gate function.

For realizing the aforesaid objective, the present invention provides a GOA circuit, comprising a plurality of GOA circuit units which are cascade coupled, wherein n is set to be a natural number larger than 0, and the nth level GOA circuit unit comprises:

a first thin film transistor, of which a source and a drain are respectively coupled to a first node and inputted with a forward scan control signal, and as the nth level is not one of the first two levels, a gate is coupled to a signal output point of an n−2th level GOA circuit unit, otherwise, the gate is inputted with a first activation signal;

a third thin film transistor, of which a source and a drain are respectively coupled to the first node and inputted with a backward scan control signal, and as the nth level is not one of the last two levels, a gate is coupled to a signal output point of an n+2th level GOA circuit unit, otherwise, the gate is inputted with a second activation signal;

a seventh thin film transistor, of which a gate is coupled to the first node, and a source and a drain are respectively coupled to a fourth node and a constant low voltage level;

a sixth thin film transistor, of which a gate is coupled to the fourth node, and a source and a drain are respectively coupled to the first node and the constant low voltage level;

a fifth thin film transistor, of which a gate is coupled to a first constant high voltage level, and a source and a drain are respectively coupled to the first node and a second node;

an eighth thin film transistor, of which a gate is inputted with a first clock signal, and a source and a drain are respectively coupled to the fourth node and the first constant high voltage level;

a ninth thin film transistor, of which a gate is inputted with a first control signal, and a source and a drain are respectively coupled to a third node and inputted with a second clock signal;

a tenth thin film transistor, of which a gate is inputted with a second control signal, and a source and a drain are respectively coupled to the third node and a second constant high voltage level;

a second thin film transistor, of which a gate is coupled to the second node, and a source and a drain are respectively coupled to a signal output point of the nth level GOA circuit unit and the third node;

a first capacitor, of which two ends are respectively coupled to the second node and the signal output point of the nth level GOA circuit unit;

a fourth thin film transistor, of which a gate is coupled to a fourth node, and a source and a drain are respectively coupled to the signal output point of the nth level GOA circuit unit and the constant low voltage level;

a second capacitor, of which two ends are respectively coupled to the fourth node and the constant low voltage level;

As the first control signal is the high voltage level, the second control signal is the low voltage level; as the first control signal is the low voltage level, the second control signal is the high voltage level.

A voltage of the second constant high voltage level is smaller than a voltage of the first constant high voltage level.

A chamfered voltage is adjusted by adjusting a voltage corresponding to the second constant high voltage level.

A chamfered duration is adjusted by adjusting a time relationship corresponding to the first control signal and the second control signal.

wherein the first clock signal and the second clock signal are square waves that duty ratios are 0.25, and phases of the first clock signal and the second clock signal are different with a quarter cycle.

For the first two level GOA circuit units, as the forward scan starts, the gate of the first thin film transistor is inputted with a high voltage level signal to be the first activation signal.

For the last two level GOA circuit units, as the backward starts, the gate of the third thin film transistor is inputted with a high voltage level signal to be the second activation signal.

The circuit is a GOA circuit of a LTPS panel.

The circuit is a GOA circuit of an OLED panel.

The present invention further provides a GOA circuit, comprising a plurality of GOA circuit units which are cascade coupled, wherein n is set to be a natural number larger than 0, and the nth level GOA circuit unit comprises:

a first thin film transistor, of which a source and a drain are respectively coupled to a first node and inputted with a forward scan control signal, and as the nth level is not one of the first two levels, a gate is coupled to a signal output point of an n−2th level GOA circuit unit, otherwise, the gate is inputted with a first activation signal;

a third thin film transistor, of which a source and a drain are respectively coupled to the first node and inputted with a backward scan control signal, and as the nth level is not one of the last two levels, a gate is coupled to a signal output point of an n+2th level GOA circuit unit, otherwise, the gate is inputted with a second activation signal;

a seventh thin film transistor, of which a gate is coupled to the first node, and a source and a drain are respectively coupled to a fourth node and a constant low voltage level;

a sixth thin film transistor, of which a gate is coupled to the fourth node, and a source and a drain are respectively coupled to the first node and the constant low voltage level;

a fifth thin film transistor, of which a gate is coupled to a first constant high voltage level, and a source and a drain are respectively coupled to the first node and a second node;

an eighth thin film transistor, of which a gate is inputted with a first clock signal, and a source and a drain are respectively coupled to the fourth node and the first constant high voltage level;

a ninth thin film transistor, of which a gate is inputted with a first control signal, and a source and a drain are respectively coupled to a third node and inputted with a second clock signal;

a tenth thin film transistor, of which a gate is inputted with a second control signal, and a source and a drain are respectively coupled to the third node and a second constant high voltage level;

a second thin film transistor, of which a gate is coupled to the second node, and a source and a drain are respectively coupled to a signal output point of the nth level GOA circuit unit and the third node;

a first capacitor, of which two ends are respectively coupled to the second node and the signal output point of the nth level GOA circuit unit;

a fourth thin film transistor, of which a gate is coupled to a fourth node, and a source and a drain are respectively coupled to the signal output point of the nth level GOA circuit unit and the constant low voltage level;

a second capacitor, of which two ends are respectively coupled to the fourth node and the constant low voltage level;

at work, as the first control signal is the high voltage level, the second control signal is the low voltage level; as the first control signal is the low voltage level, the second control signal is the high voltage level;

wherein a voltage of the second constant high voltage level is smaller than a voltage of the first constant high voltage level;

wherein the first clock signal and the second clock signal are square waves that duty ratios are 0.25, and phases of the first clock signal and the second clock signal are different with a quarter cycle.

In conclusion, the present invention provides a new GOA circuit. The circuit possesses MLG function, which can effectively reduce the feedthrough and improve the Vcom uniformity in the panel to promote the quality of the image display.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

Figure 1:
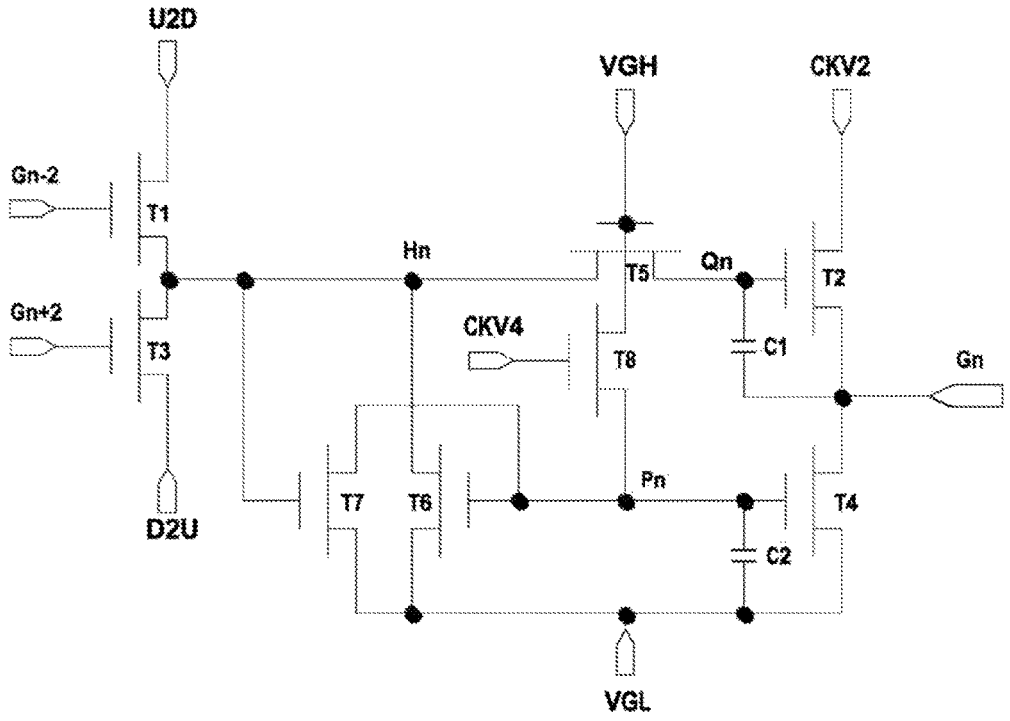
FIG. 1 is a diagram of a GOA circuit according to prior art.
Figure 2:
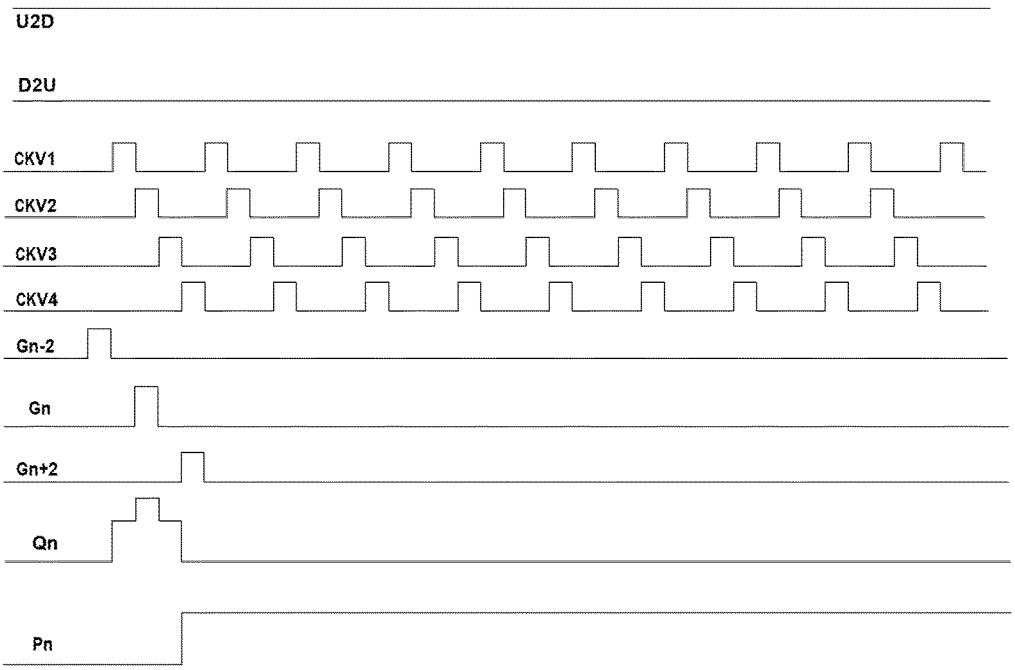
FIG. 2 is a forward scan sequence diagram of the GOA circuit in FIG. 1.
Figure 3:
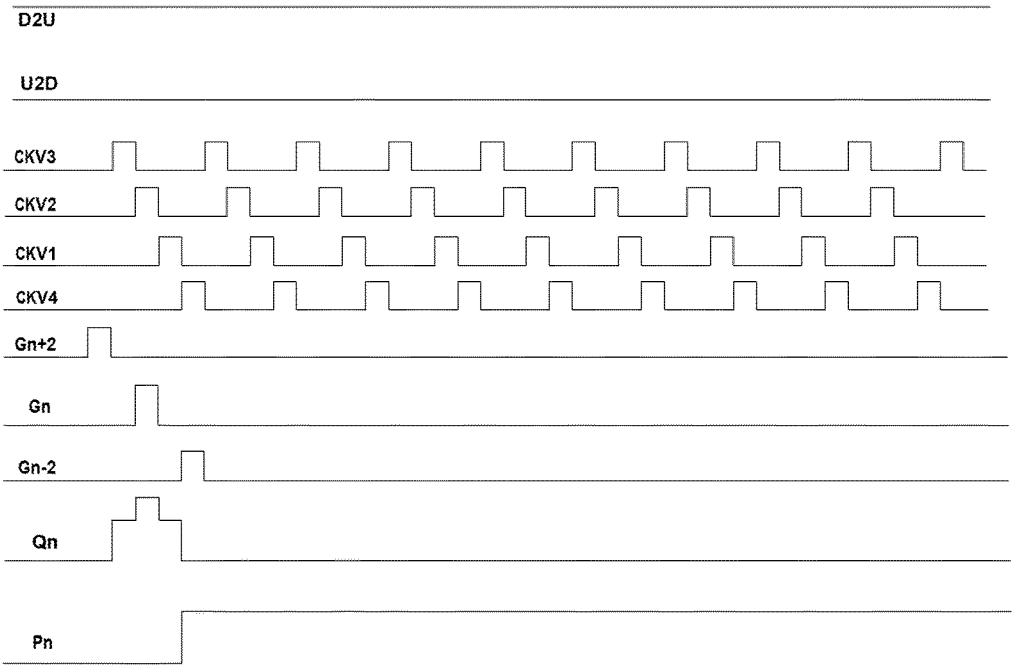
FIG. 3 is a backward scan sequence diagram of the GOA circuit in FIG. 1.
Figure 4:
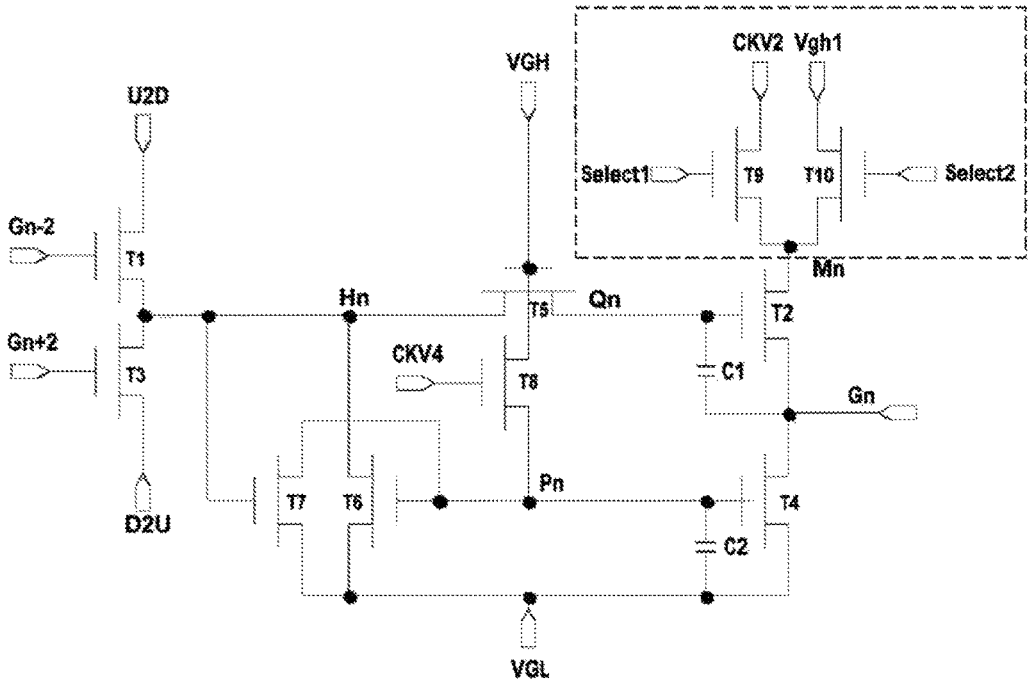
FIG. 4 is a diagram of a GOA circuit according to the present invention.

Please refer to FIG. 4, which is a diagram of a GOA circuit according to the present invention. The GOA circuit of the present invention comprises a plurality of GOA circuit units which are cascade coupled, wherein n is set to be a natural number larger than 0, and the nth level GOA circuit unit outputting a nth level horizontal scan signal comprises: a first thin film transistor T1, of which as the nth level is not one of the first two levels, a gate is coupled to a signal output point Gn−2 of the n−2th level GOA circuit unit, and a source and a drain are respectively coupled to a node Hn and inputted with a forward scan control signal U2D; a second thin film transistor T2, of which a gate is coupled to the node Qn, and a source and a drain are respectively coupled to a signal output point Gn of the nth level GOA circuit unit and a node Mn; a third thin film transistor T3, of which as the nth level is not one of the last two levels, a gate is coupled to a signal output point Gn+2 of the n+2th level GOA circuit unit, and a source and a drain are respectively coupled to the node Hn and inputted with the forward scan control signal D2U; a fourth thin film transistor T4, of which a gate is coupled to a node Pn, and a source and a drain are respectively coupled to the signal output point Gn and the constant low voltage level VGL; a fifth thin film transistor T5, of which a gate is coupled to a constant high voltage level VGH, and a source and a drain are respectively coupled to the node Hn and a node Qn; a sixth thin film transistor T6, of which a gate is coupled to the node Pn, and a source and a drain are respectively coupled to the node Hn and the constant low voltage level VGL; a seventh thin film transistor T7, of which a gate is coupled to the node Hn, and a source and a drain are respectively coupled to the node Pn and a constant low voltage level VGL; an eighth thin film transistor T8, of which a gate is inputted with a clock signal CKV4, and a source and a drain are respectively coupled to the node Pn and the constant high voltage level VGH; a ninth thin film transistor T9, of which a gate is inputted with a control signal Select1, and a source and a drain are respectively coupled to the node Mn and inputted with a clock signal CKV2; a tenth thin film transistor T10, of which a gate is inputted with a control signal Select2, and a source and a drain are respectively coupled to the node Mn and a constant high voltage level Vgh1; a first capacitor C1, of which two ends are respectively coupled to the node Qn and the signal output point Gn; a second capacitor C2, of which two ends are respectively coupled to the node Pn and the constant low voltage level VGL; at work, as the control signal Select1 is the high voltage level, the control signal Select2 is the low voltage level; as the control signal Select1 is the low voltage level, the control signal Select2 is the high voltage level. The GOA circuit of the present invention can be a GOA circuit of a LTPS panel or an OLED panel.

FIG. 4 depicts the structure of the GOA circuit unit of the present invention with the nth level GOA circuit unit corresponding to the output of the level Gn to be an illustration. The people who are skilled in this field can understand that the structure of the adjacent n+1th level GOA circuit unit corresponding to the output of the level Gn+1 is the same as what is shown in FIG. 4 but only the different clock signal is utilized at work. The description for the structure of the n+1th level GOA circuit unit is omitted here.

Figure 5:
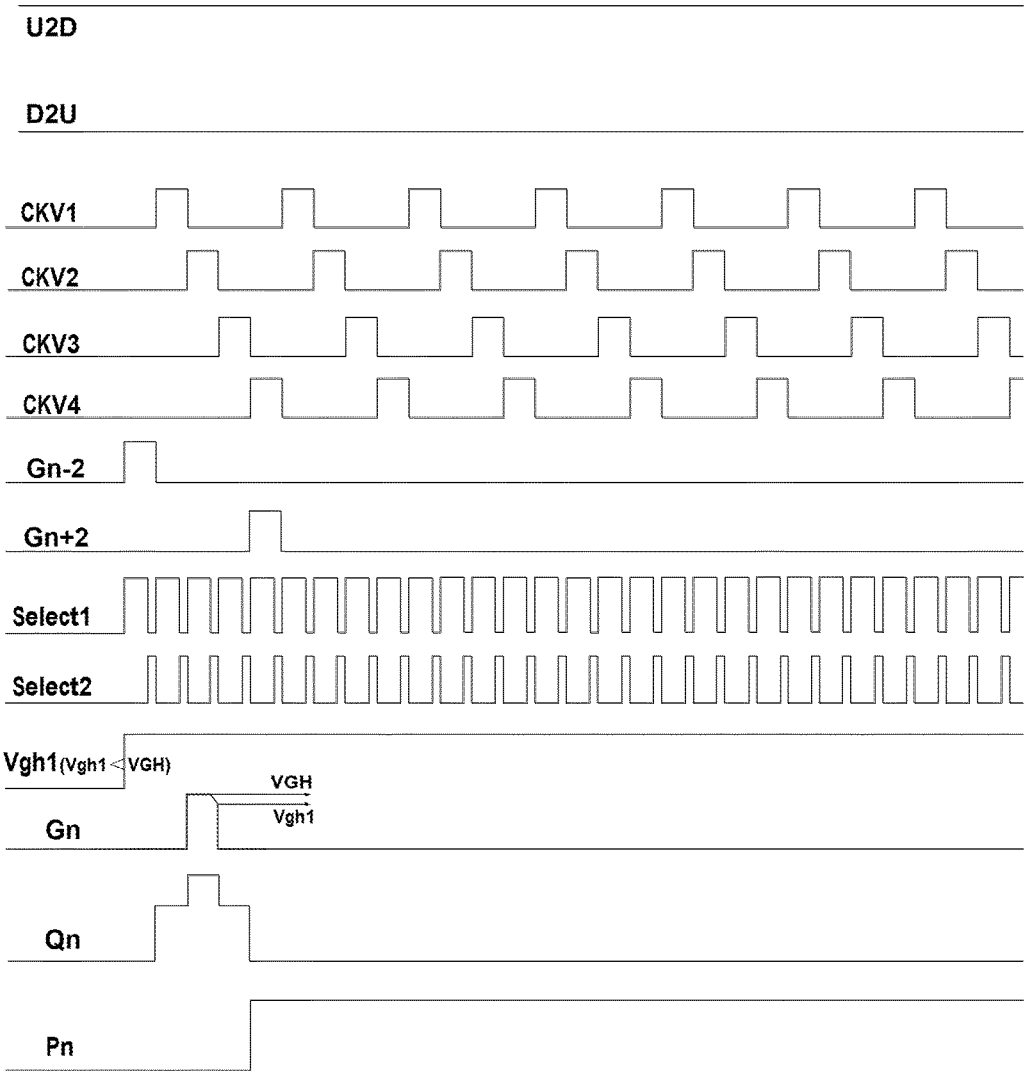
FIG. 5 is a forward scan sequence diagram of the GOA circuit in FIG. 4.

Please refer to FIG. 5, which is a forward scan sequence diagram of the GOA circuit in FIG. 4. With combination of FIG. 4, the specific work process (forward scan) of the circuit is introduced below:

the output of the level Gn is illustrated; as forward scan, U2D is the high voltage level, and D2U is the low voltage level;

stage 1, pre-charge stage, Gn−2 and U2D are the high voltage levels at the same time, and T1 is on, and the point Hn is pre-charged. As the point Hn is the high voltage level, T5 is in an on state, and the point Qn is pre-charged. As the point Hn is the high voltage level, T7 is in an on state, and the point Pn is pulled down;

stage 2, Gn outputs the high voltage level: in stage 1, the point Qn is pre-charged, and C1 has a certain maintaining function to the electrical charges, and T2 is in an on state: as CKV2 and Select1 are the high voltage levels at the same time, the high voltage level corresponding to CKV2 is outputted to the point Mn, and then T2 is in an on state, and the high voltage level of the point Mn is outputted to the point Gn; as Select2 is the high voltage level, the high voltage level corresponding to Vgh1 is outputted to the point Mn, and then T2 is in an on state, and the high voltage level corresponding to the point Mn is outputted to the point Gn, again, and Vgh1<VGH, the point Gn realizes the MLG function. While realizing the MLG function, the value of the chamfered voltage, i.e. the voltage after lowering the high voltage level VGH outputted by the point Gn can be realized by adjusting a voltage corresponding to Vgh1; the length of the chamfered duration, i.e. the duration after outputting the high voltage level VGH is lowered to outputting Vgh1 by the point Gn can be realized by adjusting a time relationship corresponding to Select1 and Select2.

stage 3, Gn outputs the low voltage level: C1 has the maintaining function to the high voltage level to the point Qn, and then Select1 is the high voltage level, and the low voltage level of CKV2 pulls down the point Gn;

stage 4, the point Qn is pulled down to VGL: as Gn+2 is the high voltage level, D2U is the low voltage level, and T3 is in an on state, and thus, the point Qn is pulled down to be VGL;

stage 5, the point Qn and the point of Gn maintain the low voltage level: after the point Qn becomes the low voltage level, T7 is in an off state, and as CKV4 jumps to the high voltage level, T8 is on, and the point Pn is charge, and then both T4 and T6 are in an on state, which can ensure the low voltage level stabilities of the point Qn and the point Gn, and meanwhile, C2 has a certain maintaining function to the high voltage level of the point Pn.

For the first two level GOA circuit units, as the forward scan starts, the gate of the first thin film transistor T1 needs to be inputted with a high voltage level signal to be the first activation signal. For the first and the last level GOA circuit units which are cascade coupled, the activation signal can be used to input for replacing the absent signal input.

For the n+1th level GOA circuit unit corresponding to the output of the level Gn+1, i.e. the level Gn+1, the clock signals used as forward scan are CKV1 and CKV3, and the work process can be similarly obtained with combination of FIG. 5.

Figure 6:
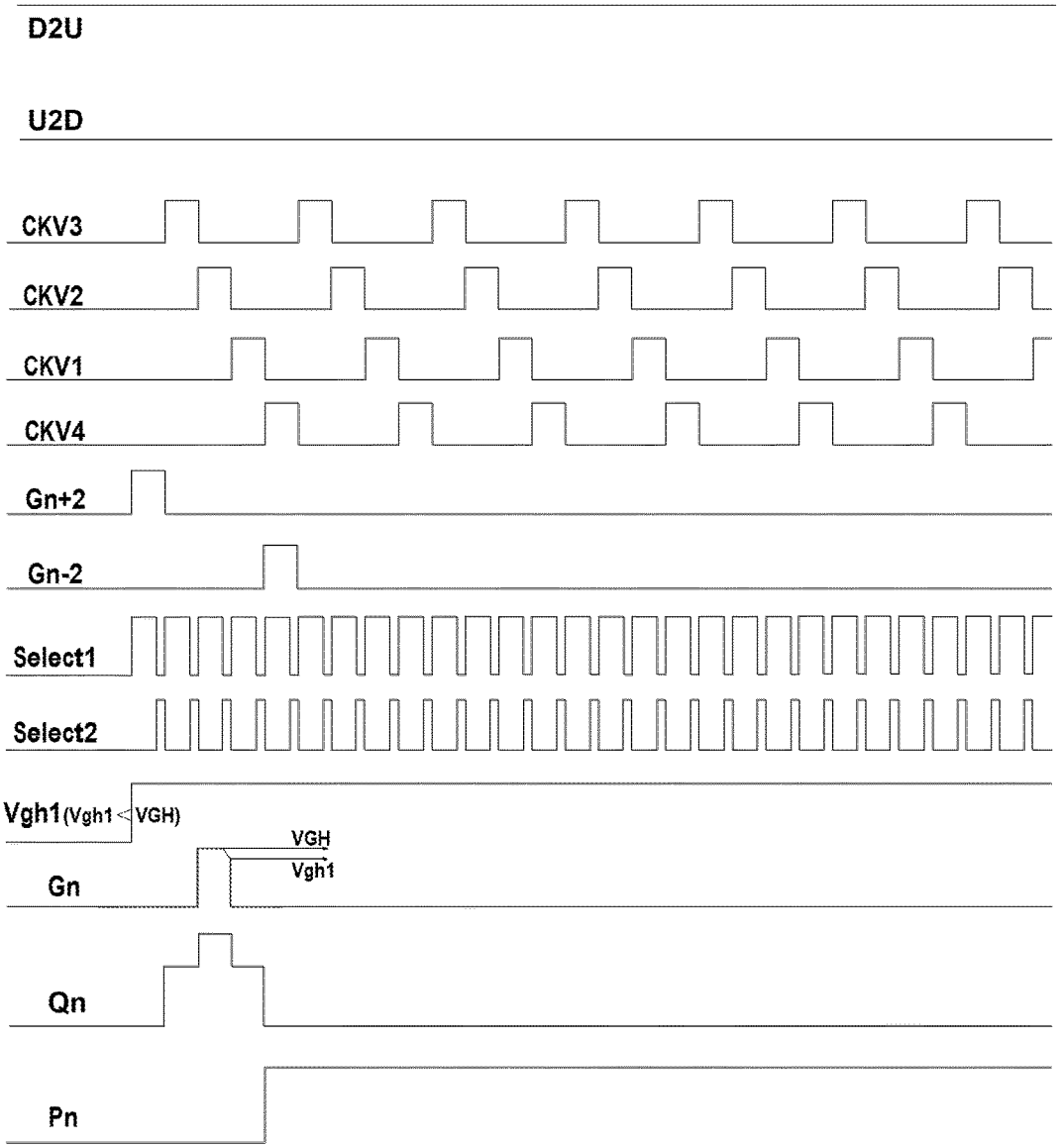
FIG. 6 is a backward scan sequence diagram of the GOA circuit in FIG. 4.

Please refer to FIG. 6, which is a backward scan sequence diagram of the GOA circuit in FIG. 4. With combination of FIG. 4, the specific work process (backward scan) of the circuit is introduced below:

the output of the level Gn is illustrated; as forward scan, D2U is the high voltage level, and U2D is the low voltage level;

stage 1, pre-charge stage, Gn+2 and D2U are the high voltage levels at the same time, and T3 is on, and the point Hn is pre-charged. As the point Hn is the high voltage level, T5 is in an on state, and the point Qn is pre-charged. As the point Hn is the high voltage level, T7 is in an on state, and the point Pn is pulled down;

stage 2, Gn outputs the high voltage level: in stage 1, the point Qn is pre-charged, and C1 has a certain maintaining function to the electrical charges, and T2 is in an on state: as CKV2 and Select1 are the high voltage levels at the same time, the high voltage level corresponding to CKV2 is outputted to the point Mn, and then T2 is in an on state, and the high voltage level of the point Mn is outputted to the point Gn; as Select2 is the high voltage level, the high voltage level corresponding to Vgh1 is outputted to the point Mn, and then T2 is in an on state, and the high voltage level corresponding to the point Mn is outputted to the point Gn, again, and Vgh1<VGH, the point Gn realizes the MLG function. Meanwhile, the chamfered voltage can be realized by adjusting a voltage corresponding to Vgh1, and the chamfered duration can be realized by adjusting a time relationship corresponding to Select1 and Select2.

stage 3, Gn outputs the low voltage level: C1 has the maintaining function to the high voltage level to the point Qn, and then Select1 is the high voltage level, and the low voltage level of CKV2 pulls down the point Gn;

stage 4, the point Qn is pulled down to VGL: as Gn−2 is the high voltage level, U2D is the low voltage level, and T1 is in an on state, and thus, the point Qn is pulled down to be VGL;

stage 5, the point Qn and the point of Gn maintain the low voltage level: after the point Qn becomes the low voltage level, T7 is in an off state, and as CKV4 jumps to the high voltage level, T8 is on, and the point Pn is charge, and then both T4 and T6 are in an on state, which can ensure the low voltage level stabilities of the point Qn and the point Gn, and meanwhile, C2 has a certain maintaining function to the high voltage level of the point Pn.

For the last two level GOA circuit units, as the backward starts, the gate of the third thin film transistor T3 needs to be inputted with a high voltage level signal to be the second activation signal. For the first and the last level GOA circuit units which are cascade coupled, the activation signal can be used to input for replacing the absent signal input.

For the n+1th level GOA circuit unit corresponding to the output of the level Gn+1, i.e. the level Gn+1, the clock signals used as backward scan are CKV1 and CKV3, and the work process can be similarly obtained with combination of FIG. 6.

As shown in FIG. 5, FIG. 6, the clock signals CKV1-4 are square waves that duty ratios are 0.25, and the phases of the clock signal CKV4 and the clock signal CKV2 are different with a quarter cycle, and the phases of the clock signal CKV3 and the clock signal CKV1 are different with a quarter cycle.

As shown in the dotted lines portion of FIG. 4, the present invention introduces two control signals Select1, Select2 on the basis of the GOA circuit according prior art. As the point Qn is bootstrapped to be the high voltage level: as Select1 is the high voltage level, the high voltage level corresponding to CKV2 is outputted to the point Gn, and as Select2 is the high voltage level, the high voltage level corresponding to Vgh1 is outputted to the point Gn, and the high voltage level corresponding to Vgh1 is smaller than VGH, i.e. Vgh1<VGH. Then, the output of the point Gn realizes the 3 stages MLG function. It can effectively reduce the feedthrough and improve the Vcom uniformity in the panel to promote the quality of the image display. Meanwhile, the chamfered voltage can be realized by adjusting a voltage corresponding to Vgh1, and the chamfered duration can be realized by adjusting a time relationship corresponding to Select1 and Select2.

The known and potential technology/product application field and the application thereof of the GOA circuit of the present invention are below: 1. liquid crystal display row scan (Gate) drive circuit integrated on the array substrate; 2 gate drive field applied for mobile phone, display and television; 3, advanced technology covering the LCD and OLED industries; 4, high resolution panel design, in which the stability of the present circuit is suitable.

In conclusion, the present invention provides a new GOA circuit. The circuit possesses MLG function, which can effectively reduce the feedthrough and improve the Vcom uniformity in the panel to promote the quality of the image display.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A gate driver on array (GOA) circuit, comprising a plurality of GOA circuit units which are cascade coupled, wherein n is set to be a natural number larger than 0, and the nth level GOA circuit unit comprises:

a first thin film transistor, of which a source and a drain of the first transistor are directly coupled to a first node and inputted with a forward scan control signal, and as the nth level is not one of the first two levels, a gate is coupled to a signal output point of an n−2th level GOA circuit unit, otherwise, the gate is inputted with a first activation signal;

a third thin film transistor, of which a source and a drain of the third transistor are directly coupled to the first node and inputted with a backward scan control signal, and as the nth level is not one of the last two levels, a gate is coupled to a signal output point of an n+2th level GOA circuit unit, otherwise, the gate is inputted with a second activation signal;

a seventh thin film transistor, of which a gate is coupled to the first node, and a source and a drain of the seventh transistor are directly coupled to a fourth node and a constant low voltage level;

a sixth thin film transistor, of which a gate is coupled to the fourth node, and a source and a drain of the sixth transistor are directly coupled to the first node and the constant low voltage level;

a fifth thin film transistor, of which a gate is coupled to a first constant high voltage level, and a source and a drain of the fifth transistor are directly coupled to the first node and a second node;

an eighth thin film transistor, of which a gate is inputted with a first clock signal, and a source and a drain of the eighth transistor are directly coupled to the fourth node and the first constant high voltage level;

a ninth thin film transistor, of which a gate is inputted with a first control signal, and a source and a drain of the ninth transistor are directly coupled to a third node and inputted with a second clock signal;

a tenth thin film transistor, of which a gate is inputted with a second control signal, and a source and a drain of the tenth transistor are directly coupled to the third node and a second constant high voltage level;

a second thin film transistor, of which a gate is coupled to the second node, and a source and a drain of the second transistor are directly coupled to a signal output point of the nth level GOA circuit unit and the third node;

a first capacitor, of which two ends are respectively coupled to the second node and the signal output point of the nth level GOA circuit unit;

a fourth thin film transistor, of which a gate is coupled to a fourth node, and a source and a drain of the fourth transistor are directly coupled to the signal output point of the nth level GOA circuit unit and the constant low voltage level;

a second capacitor, of which two ends are respectively coupled to the fourth node and the constant low voltage level;

at work, as the first control signal is a high voltage level, the second control signal is a low voltage level; as the first control signal is the low voltage level, the second control signal is the high voltage level.

2. The GOA circuit according to claim 1, wherein a voltage of the second constant high voltage level is smaller than a voltage of the first constant high voltage level.

3. The GOA circuit according to claim 1, wherein a chamfered voltage is adjusted by adjusting a voltage corresponding to the second constant high voltage level.

4. The GOA circuit according to claim 1, wherein a chamfered duration is adjusted by adjusting a time relationship corresponding to the first control signal and the second control signal.

5. The GOA circuit according to claim 1, wherein the first clock signal and the second clock signal are square waves that duty ratios are 0.25, and phases of the first clock signal and the second clock signal are different with a quarter cycle.

6. The GOA circuit according to claim 1, wherein for the first two level GOA circuit units, as the forward scan starts, the gate of the first thin film transistor is inputted with a high voltage level signal to be the first activation signal.

7. The GOA circuit according to claim 1, wherein for the last two level GOA circuit units, as the backward scan starts, the gate of the third thin film transistor is inputted with a high voltage level signal to be the second activation signal.

8. The GOA circuit according to claim 1, wherein the circuit is a GOA circuit of a LTPS panel.

9. The GOA circuit according to claim 1, wherein the circuit is a GOA circuit of an OLED panel.

10. A gate driver on array (GOA) circuit, comprising a plurality of GOA circuit units which are cascade coupled, wherein n is set to be a natural number larger than 0, and the nth level GOA circuit unit comprises:

a first thin film transistor, of which a source and a drain of the first transistor are directly coupled to a first node and inputted with a forward scan control signal, and as the nth level is not one of the first two levels, a gate is coupled to a signal output point of an n−2th level GOA circuit unit, otherwise, the gate is inputted with a first activation signal;

a third thin film transistor, of which a source and a drain of the third transistor are directly coupled to the first node and inputted with a backward scan control signal, and as the nth level is not one of the last two levels, a gate is coupled to a signal output point of an n+2th level GOA circuit unit, otherwise, the gate is inputted with a second activation signal;

a seventh thin film transistor, of which a gate is coupled to the first node, and a source and a drain of the seventh transistor are directly coupled to a fourth node and a constant low voltage level;

a sixth thin film transistor, of which a gate is coupled to the fourth node, and a source and a drain of the sixth transistor are directly coupled to the first node and the constant low voltage level;

a fifth thin film transistor, of which a gate is coupled to a first constant high voltage level, and a source and a drain of the fifth transistor are directly coupled to the first node and a second node;

an eighth thin film transistor, of which a gate is inputted with a first clock signal, and a source and a drain of the eighth transistor are directly coupled to the fourth node and the first constant high voltage level;

a ninth thin film transistor, of which a gate is inputted with a first control signal, and a source and a drain of the ninth transistor are directly coupled to a third node and inputted with a second clock signal;

a tenth thin film transistor, of which a gate is inputted with a second control signal, and a source and a drain of the tenth transistor are directly coupled to the third node and a second constant high voltage level;

a second thin film transistor, of which a gate is coupled to the second node, and a source and a drain of the second transistor are directly coupled to a signal output point of the nth level GOA circuit unit and the third node;

a first capacitor, of which two ends are respectively coupled to the second node and the signal output point of the nth level GOA circuit unit;

a fourth thin film transistor, of which a gate is coupled to a fourth node, and a source and a drain of the fourth transistor are directly coupled to the signal output point of the nth level GOA circuit unit and the constant low voltage level;

a second capacitor, of which two ends are respectively coupled to the fourth node and the constant low voltage level;

at work, as the first control signal is a high voltage level, the second control signal is a low voltage level; as the first control signal is the low voltage level, the second control signal is the high voltage level;

wherein a voltage of the second constant high voltage level is smaller than a voltage of the first constant high voltage level;

wherein the first clock signal and the second clock signal are square waves that duty ratios are 0.25, and phases of the first clock signal and the second clock signal are different with a quarter cycle.

11. The GOA circuit according to claim 10, wherein a chamfered voltage is adjusted by adjusting a voltage corresponding to the second constant high voltage level.

12. The GOA circuit according to claim 10, wherein a chamfered duration is adjusted by adjusting a time relationship corresponding to the first control signal and the second control signal.

13. The GOA circuit according to claim 10, wherein for the first two level GOA circuit units, as the forward scan starts, the gate of the first thin film transistor is inputted with a high voltage level signal to be the first activation signal.

14. The GOA circuit according to claim 10, wherein for the last two level GOA circuit units, as the backward starts, the gate of the third thin film transistor is inputted with a high voltage level signal to be the second activation signal.

15. The GOA circuit according to claim 10, wherein the circuit is a GOA circuit of a LTPS panel.

16. The GOA circuit according to claim 10, wherein the circuit is a GOA circuit of an OLED panel.

* * * * *